US008096385B2

(12) United States Patent
Tarkhani et al.

(10) Patent No.: US 8,096,385 B2
(45) Date of Patent: Jan. 17, 2012

(54) BELAYER/DESCENDER SAFETY DEVICE

(75) Inventors: Slim Tarkhani, Seilh (FR); Guy Valembois, Blagnac (FR)

(73) Assignee: Glisswin, L'Isle Jourdain (FR)

( * ) Notice: Subject to any disclaimer, the term of this patent is extended or adjusted under 35 U.S.C. 154(b) by 997 days.

(21) Appl. No.: 11/997,882

(22) PCT Filed: Aug. 3, 2006

(86) PCT No.: PCT/FR2006/050781

§ 371 (c)(1),
(2), (4) Date: Feb. 4, 2008

(87) PCT Pub. No.: WO2007/015032

PCT Pub. Date: Feb. 8, 2007

(65) Prior Publication Data

US 2008/0210488 A1 Sep. 4, 2008

(30) Foreign Application Priority Data

Aug. 4, 2005 (FR) ..... 05 52427

(51) Int. Cl.
*A62B 1/10* (2006.01)

(52) U.S. Cl. ..... 182/192; 182/5

(58) Field of Classification Search ..... 182/234, 182/239, 71, 192, 241, 5; 188/65.3
See application file for complete search history.

(56) References Cited

U.S. PATENT DOCUMENTS

| | | | | |
|---|---|---|---|---|
| 1,190,483 | A * | 7/1916 | Tibbals | 182/241 |
| 2,976,955 | A * | 3/1961 | Huber | 188/65.1 |
| 5,127,490 | A * | 7/1992 | Sheu | 182/5 |
| 5,168,958 | A | 12/1992 | Wullimann | |
| 7,845,467 | B2 * | 12/2010 | Petzl et al. | 182/5 |

FOREIGN PATENT DOCUMENTS

GB 2 044 414 A 10/1980

OTHER PUBLICATIONS

International Search Report of PCT/FR2006/050781, date of mailing Jan. 4, 2007.

* cited by examiner

*Primary Examiner* — Alvin Chin Shue
(74) *Attorney, Agent, or Firm* — Westerman, Hattori, Daniels & Adrian, LLP

(57) ABSTRACT

The invention relates to a belayer/descender safety device (1), cooperating with a rope (2), comprising means (5) to hold said rope (2) and rotationally fixed to a chassis (6) on which enclosure means (10) for said rope (2) are mounted with pivoting and cooperating with said holding means (5). The enclosure means (10) and the chassis (6) comprise a housing (12) in opposition in the locking position which cooperates with a hook means, in particular, a spring hook, wherein said holding means (5) has the form of a pulley housing means for regulation of the speed of rotation thereof.

14 Claims, 2 Drawing Sheets

BELAYER/DESCENDER SAFETY DEVICE

BACKGROUND OF THE INVENTION (1) Field of the Invention

The present invention relates to a belayer/descender safety device, aimed at cooperating with a rope, comprising means capable of receiving said rope and integral in rotation with a frame on which are pivotally mounted means for holding said rope capable of cooperating with said receiving means, said holding means and the frame comprising in opposition, in holding position, a recess aimed at cooperating with coupling means, in particular a spring hook.

The present invention relates to the field of mountaineering, alpinism and the like, it relates in particular to the safety devices aimed at retaining a person. In addition, the invention also finds its application in the rescue and the evacuation of persons.

Mountaineering and alpinism are high-risk sports that require prudence and caution, while complying with strict safety requirements. The material used is continuously object of modifications in order to improve its strength, to simplify its use, to decrease its weight, etc.

The present invention falls within the framework of this improvement and thus relates to a safety device, in particular of type descender, belayer or the like.

(2) Description of the Prior Art

A descender allows a person to retain himself on a rope in order to descend along a wall, a slope or the like. A known descender is the eight-shaped descender, because of its shape, and is often used for the descent referred to as abseiling. Since it is very easy to be used, it requires that the climber holds the rope, or free side of the rope, and does however not allow blocking the rope in the event of a fall or a release of the rope by the person. Such a descender is a multi-purpose device and can also be used to retain a person climbing or descending a wall. It has however the same drawback of not blocking the rope if the latter is released by the person who retains the climber.

The blocker namely solves this problem by blocking the rope under the action of the climber. Such a device generally comprises a trigger for its actuation and a toothed recess for ensuring the immobilization on a rope. The blocker is anyway aimed at allowing the ascent along a rope.

That is why the state of the art also comprises retaining systems such as a belayer and plate, aimed at ensuring in a fully safe way the ascent or the descent of a climber by another person. These retaining systems have the peculiarity of being used in combination with a safety snap-hook, namely with a screw or automatic closing action.

Being in multiple shapes and for multiple uses, these retaining systems comprise, in particular, an auto-blocking and auto-braking belayer/descender. Such a device allows blocking in the event of a fall as soon as a high tension is exerted on the rope, without requiring maintaining the free side of the latter. To this end, this device includes two grooved pulleys aimed at receiving the rope and is articulated so as to open into two parts, by pivoting along the axis of rotation of one of said pulleys, in order to allow the insertion of said rope. The two parts include an opening provided for in front of each other in closed position, in order to receive a spring hook. One of said pulleys is mounted so as to be capable of pivoting on its axis, so as to grip the rope, thus stopping its running.

A handle is used to unblock the rope, in order to allow the descent referred to as windmilling descent, by braking the rope, but it is then necessary to hold the free side of the rope.

Such a device is however limited to climbing indoors or on a cliff, in an already well-equipped place as regards safety means.

Another drawback of the devices of the state of the art is the possibility for the rope to glide, since the friction forces are no longer high enough to counteract the weight during a fall. In addition, the stoppage in the event of a fall is often brutal and sudden, and can thus cause the climber to knock against the wall.

SUMMARY OF THE INVENTION

The aim of the present invention is to cope with the drawbacks of the state of the art by providing a belayer/descender safety device that is easy to be used and can be installed quickly, is light and provides optimal safety. In particular, it allows controlling the speed of descent with respect to the rope. In addition, the belayer/descender according to the invention impedes any sliding of the rope and avoids the abrupt stoppages in the event of a fall.

To this end, the invention relates to a belayer/descender safety device aimed at cooperating with a rope, comprising means capable of receiving said rope and integral in rotation with a frame on which are pivotally mounted means for holding said rope capable of cooperating with said receiving means, said holding means and the frame comprising in opposition, in holding position, a recess aimed at cooperating with coupling means, in particular a spring hook, wherein said receiving means are in the form of a pulley containing means capable of controlling its speed of rotation.

According to other features of the invention, the means capable of controlling the speed of rotation of the pulley include means for reducing the speed capable of subjecting the increase in deceleration of said pulley to the increase of the speed of rotation of the latter.

Advantageously, the means capable of controlling the speed of rotation of the pulley include means for braking the pulley through friction and/or through a fluid.

Preferably, the reduction means consist of an epicyclic gear.

In particular, the reduction means include a satellite-holder rotationally mounted with respect to said pulley and holding at least one double toothed satellite cooperating through engagement, on the one hand, with a crown gear integral with said pulley, and, on the other hand, with a crown gear integral with said frame, the toothings of said crown gears being shaped so that the engagement ratio between each of said crown gears drives the satellite at a speed different from the speed of rotation of the pulley.

In addition, the satellite-holder includes means for braking the pulley through friction and/or through a fluid.

According to an embodiment, the braking means include at least one weight freely movable in radial translation with respect to the pulley and capable of cooperating through friction on a track provided for inside said pulley.

The holding means advantageously extend over the whole or part of the periphery of the pulley, so as to hold the rope in said groove and to prevent it from sliding within the latter.

The holding means preferably include at least one pulley aimed at cooperating with the rope and rotationally mounted in a space provided for the passing-through of said rope.

In addition, the recess is diametrically opposite the means preventing the sliding of the rope.

The invention also relates to a rope combined with the preceding device, which is arranged in a loop.

Further features and advantages of the invention will become clear from the following detailed description of non-restrictive embodiments of the invention, with reference to the attached figures.

DETAILED DESCRIPTION OF THE PREFERRED EMBODIMENTS

The present invention relates to a belayer/descender safety device 1, which will find its application in the field of the retaining of a person within the framework of mountaineering or alpinism, but also within the framework of rescue and evacuation.

Figure 2:
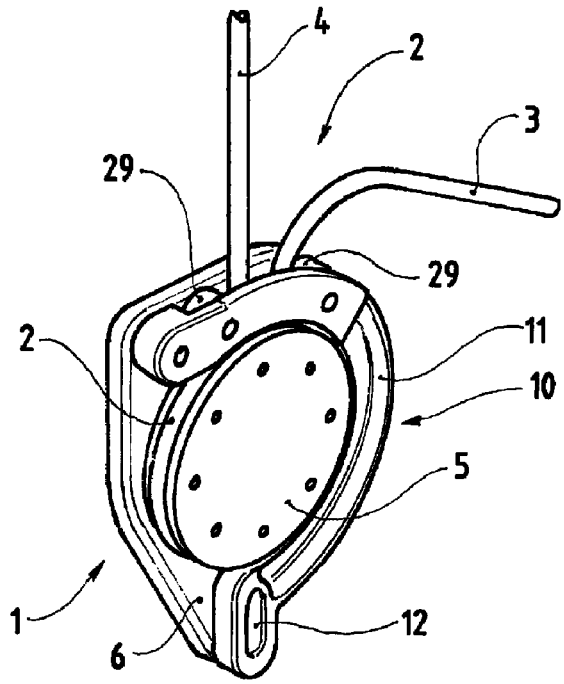
FIG. 2 is another view of the safety device coupled to a rope.

The safety device is aimed at cooperating with a rope 2. Generally, as can be seen in FIG. 2, this rope 2 comprises a free or soft side 3 which should be held in order to block the rope 2, as well as a tightened side 4, mostly connected to a fixed point, said safety device 1 being arranged between these two sides (3, 4).

In a particular mode of fixing to the rope 2 of the safety device 1, said rope 2 is arranged in a loop, i.e. its ends are connected to each other. In this way, it is then possible to cause the rope 2 to rotate ad infinitum through said device 1, without having to hoist it, which proves useful when rescuing several people one after another. In particular, the safety device 1 can be fixed at a fixed point and act as a simple pulley which then controls the speed of descent of the person secured to the rope 2.

Therefore, said safety device 1 includes means 5 capable of receiving said rope 2. These receiving means 5 are integral in rotation with a frame 6 and are preferably in the form of a pulley 7, the latter including a groove 8 shaped so as to cooperate with said rope 2. Said pulley 7 is freely rotationally mounted on an axis 9 on said frame 6.

Figure 1:
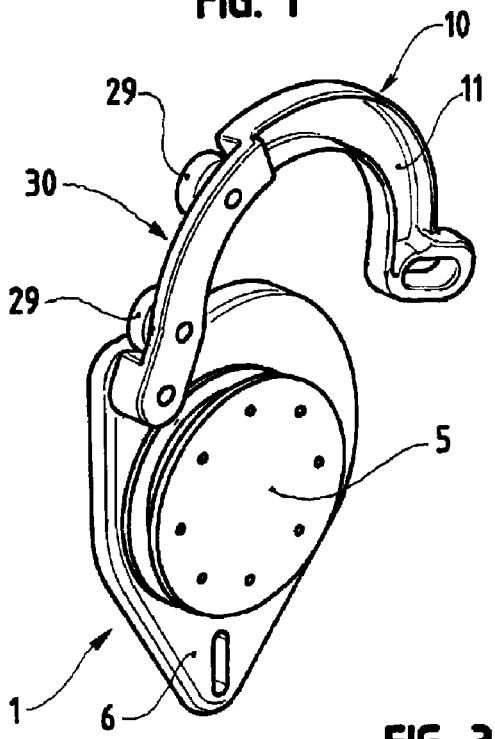
FIG. 1 shows a general view of the safety device according to the invention.

Means 10 for holding said rope 2 are pivotally mounted on said frame 6. These holding means 10 are capable of cooperating with the receiving means 5, in particular so as to block the rope 2 in the groove of the pulley 7, in order to prevent its sliding with respect to the latter. To this end, as can be seen in FIGS. 1 and 2, the holding means 10 can be in the form of an arc 11 articulated on said frame 6, in addition in rotation, but it can be contemplated to secure it through other hinging and/or securing means, for example through snapping-on.

In a very particular way, the frame 6 and the holding means 10 include, in opposition, a recess 12 aimed at cooperating with coupling means, not shown, in particular a spring hook. This recess 12 is so shaped as to allow the passing through of the spring hook in open position of the latter. Once the spring hook has been inserted, the frame 6 and the holding means 10 are blocked and made integral with each other.

This particular rotational arrangement of a pulley 7 on a frame 6, bearing the holding means 10 in pivotal arrangement, allows securing the device safety 1 in a very simple way directly to rope 2, without being obliged to tie one end of the rope 2, to coil it, etc.

One feature of the device 1 according to the invention resides in the control of the speed of descent of a person ensured through said safety device 1. To this end, said receiving means 5 contain means 13 capable of controlling the speed of rotation of said pulley 7. These control means 13 include speed-reducing means 14 capable of subjecting the increase in the deceleration of said pulley 7 to the increase the speed of rotation of the latter. The reduction means 14 preferably consist of an epicyclic gear, in particular visible in exploded view in the embodiment of FIG. 5. The pulley 7 is then used as a cage for said epicyclic gear.

Figure 4:
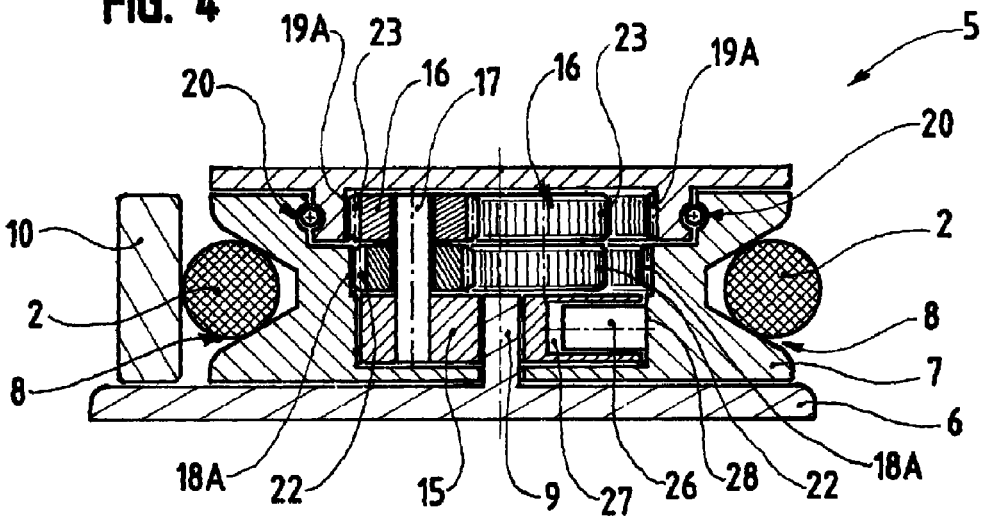
FIG. 4 is a simplified cross-sectional view of the safety device.

In this respect, when referring to FIG. 4, in which is shown a simplified embodiment of the invention, the reduction means 14 include a satellite-holder 15 rotationally mounted with respect to said pulley 7, in particular on the axis 9 integral with said frame 6. Thus, the satellite-holder 15 is freely rotating with respect to the pulley 7 and with respect to said frame 6. This satellite-holder 15 bears at least one satellite 16, rotationally mounted on an axis 17. In the preferred embodiment of the invention, the satellites 16 are three in total, respectively mounted on three axes 17 integral with said satellite-holders 15. In this case, the satellites 16 are free with respect to each other.

In a very particular way, a satellite 16 is designed toothed and double, thus cooperating through engagement, on the one hand, with a toothing 18A provided for on a track extending on the inner periphery of said pulley 7, and, on the other hand, with a toothing 19A provided for on a track extending on the inner periphery of said frame 6.

Figure 3:
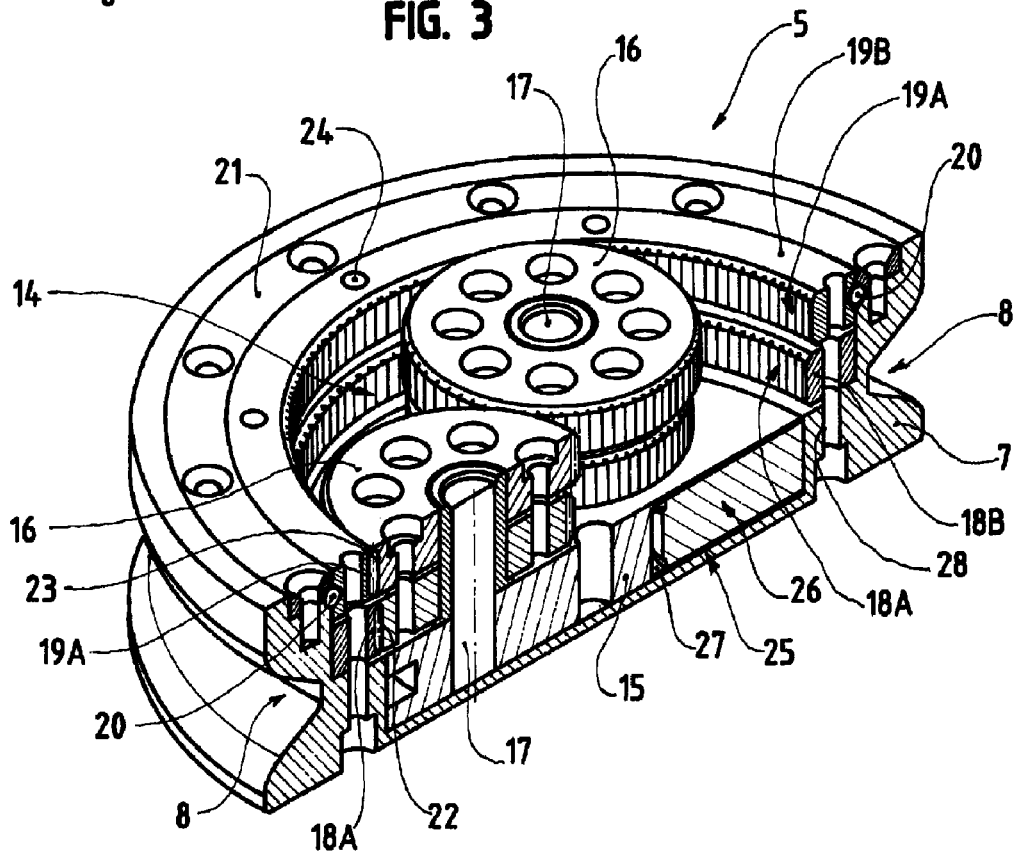
FIG. 3 is a perspective view of part of the safety device according to the invention.

It should be noted that the frame 6 is rotationally mounted with respect to said pulley 7 through a bearing 20 provided for between said pulley 7 and the frame 6. Preferably and as can be seen in the embodiment of FIG. 3, a bearing crown 21 is fixed to said pulley 7, in order to close said bearing 20. According to another embodiment, this crown 21 could be fixed to said frame 6.

The toothings 18A and 19A are so shaped that the engagement ratio between each of said toothings 18A and 19A drives the satellite 15 at a speed different from the speed of rotation of the pulley 7. Indeed, the number of teeth of each toothing 18A and 19A is different. It should be noted that a satellite 16 is designed double, with two identical toothings 22 and 23 shaped so as to cooperate with said toothings 18A and 19A, respectively. In addition, in the case of several satellites 16, the latter do not engage each other. Thus, a satellite 16 should require more time to travel over one of said toothings 18A (or 19A) than over the other toothing 19A (18A, respectively). Now, since the toothings 22 and 23 of a satellite 16 are integral, this difference results into a differential speed of rotation and into the driving of said satellite-holder 15. In this way, the engagement ratio between each of said toothings 18A and 19A drives the satellite-holder 15 at a speed different from the speed of rotation of the pulley 7.

In the preferred embodiment of the invention, the toothings 18A and 19A are replaced by a toothed crown 18B integral with said pulley 7, and, in addition, by an toothed crown 19B integral with said frame 6, respectively. These crowns 18B and 19B are removable and fixed through securing means, for example through screwing a screw through bores 24 visible in FIGS. 3 and 5.

The control means 13 advantageously include means 25 for braking the pulley 7. According to the preferred embodiment of the invention, shown in the drawings, the braking occurs through friction. In particular, these means for braking 25 through friction are included in the satellite-holder and include at least one weight 26 freely movable in radial translation with respect to the pulley 7. As can be seen in FIGS. 3 and 4, this weight 26 slides in a recess 27, under the action of the centrifugal force resulting from the rotation of the satellite-holder 15. The weight 26 is then expelled outside said housing 27 and cooperates through friction on a track 28 provided for inside said pulley 7.

During a slow rotation of the pulley 7, the weight 26 protrudes only slightly or not at all out of the recess 27, the satellite-holder having a speed substantially identical to that of the pulley 7. On the other hand, the reducing effect of the epicyclic gear accelerates the satellite-holder 15, so that the weight 26 protrudes further out of the recess 27 and enters into contact with the pulley 7, thus slowing down the latter.

Figure 5:
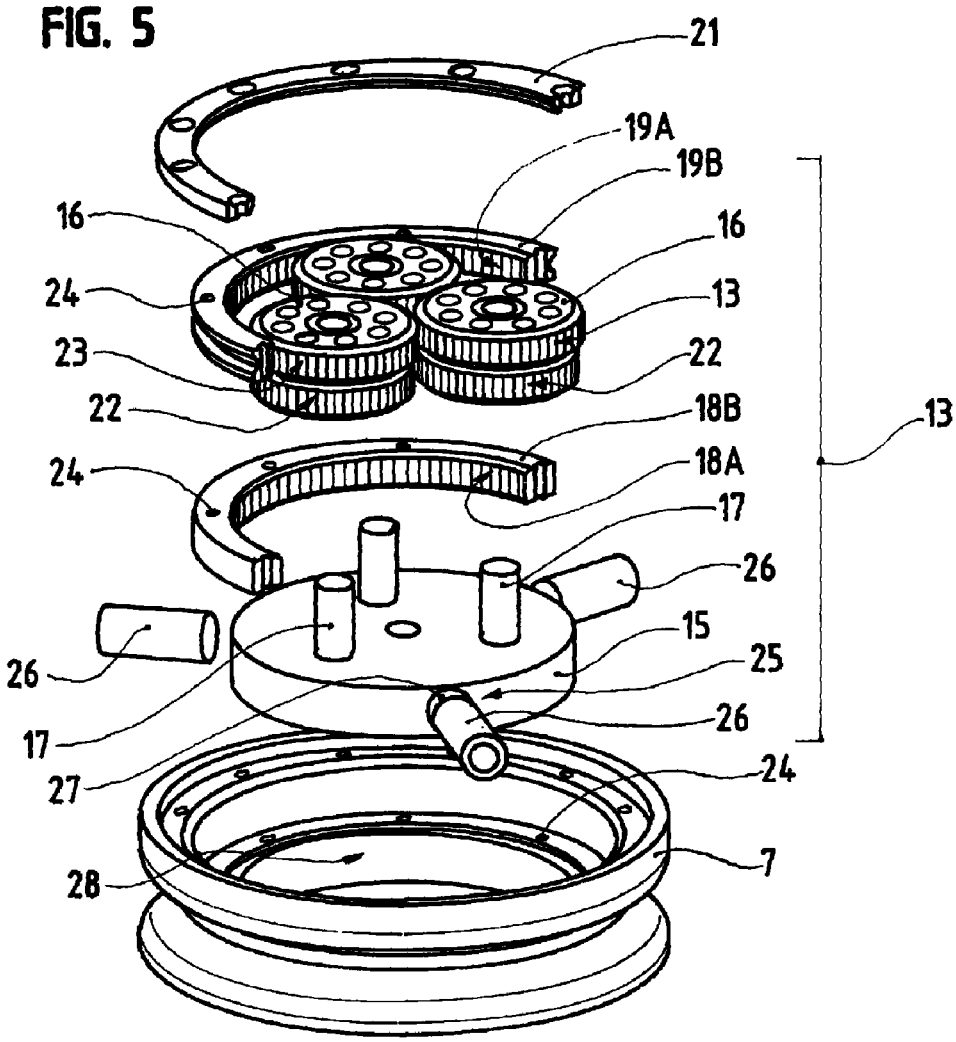
FIG. 5 is an exploded view of this part of the safety device.

As can be seen in FIG. 5, the satellite-holder 15 includes several weights 26, preferably three, each aimed at inserting into a recess 27.

According to another embodiment, not shown, braking can occur through the resistance of the pulley 7 to be driven, through a fluid, in particular oil or the like. To this end, the whole or part of the pulley 7 can be immersed into said fluid, said pulley being, in such case, designed fluid-tight.

According to yet another embodiment, the means for braking 25 through friction can be combined with braking through a fluid, in order to increase the deceleration of the pulley 7.

Another peculiarity of the safety device 1 according to the invention resides in that the rope 2 does not slide, even under the action of a strong load or a sudden and/or extended acceleration.

To this end, the holding means 10 extend over the whole or part of the periphery of the pulley 7 so as to maintain the rope 2 in said groove 8 and impede its sliding in the latter. In particular, the arc 11 extends around the pulley 7, substantially alongside half of its perimeter.

In an embodiment not shown, the holding means 10 can include two arcs removable with respect to each other and both pivotally mounted on said frame 6 by one of their ends. These arcs each include, at the level of their opposite end, an opening aimed at forming a recess 12 for receiving the spring hook, in combination with the opening of the frame 6.

As can be seen in FIGS. 1 and 2, the holding means 10 include at least one roller 29 aimed at cooperating with the rope 2 and rotationally mounted in a space 30 provided for the passing through of said rope 2. The holding means 10 preferably include two rollers 29 rotationally mounted on both sides of the space 30 and forming means preventing the sliding of the rope 2.

The sides 3 and 4 of the rope 2 are aimed at resting on each roller 29 which presses on the rope 2 inserted into the groove 8 of the pulley 7. The roller 29 improves the displacement of the rope 2 and prevents the friction of the latter on the device 1, thus avoiding premature wear. In addition, the rope 2 leaves the groove 8 substantially perpendicularly, thus preventing the rope 2 from sliding when leaving the pulley 7.

It should be noted that the walls of the groove 8 can be designed rough or not smooth, preferably with asperities, toothings or the like, improving the adhesion of the rope 2 to said pulley 7.

In addition, the adhesion recess 12 is diametrically opposite the means preventing the rope 2 from sliding, as can be seen in FIGS. 1 and 2. This particular position allows said safety device 1 to be coupled to a fixed point and to traditionally act as a pulley.

Finally, this safety device 1 can be made out of any material having the required characteristics of lightness and strength, namely out of metal.

The safety device 1 according to the invention thus allows controlling the speed of descent of a retained person, while allowing a simple, secure and fast fixing.

What is claimed:

1. Belayer/descender safety device for cooperation with a rope, comprising:

a frame, means for receiving said rope, said receiving means being in the form of a pulley rotationally mounted on the frame means for holding said rope, said holding means being pivotally mounted on the frame between an open position for positioning the rope in the receiving means and a closed position for cooperating with the receiving means to block the rope with respect to the receiving means when the holding means is coupled to the frame, means for controlling a speed of rotation of the pulley with respect to the frame, wherein the means for controlling the speed of rotation of the pulley include speed-reducing means slaving the increase in deceleration of said pulley to the increase of the speed of rotation of the pulley;

wherein the speed-reducing means comprise an epicyclic gear including a satellite-holder rotationally mounted with respect to said pulley and bearing at least one double toothed satellite gear cooperating through engagement (i) with a crown gear extended on an inner periphery of said pulley, and (ii) with a crown gear extended on an inner periphery of said frame, toothings of said crown gears being shaped so that an engagement ratio between each of said crown gears drives the satellite-holder at a speed different from the speed of rotation of the pulley.

2. Device according to claim 1, wherein the means for controlling the speed of rotation of the pulley include means for braking the pulley through friction.

3. Safety device according to claim 1, wherein the satellite-holder includes means for braking the pulley through friction and/or through a fluid.

4. Safety device according to claim 2, wherein the braking means include at least one weight freely movable in radial translation with respect to the pulley and capable of cooperating through friction on a track provided inside said pulley.

5. Safety device according to claim 1, wherein the holding means extend over the whole or part of the periphery of the pulley, so as to maintain the rope in a groove of said pulley and preventing it from sliding in the groove.

6. Safety device according to claim 3, wherein the holding means include at least one roller aimed at cooperating with the rope and rotationally mounted in a space provided for the passing through of said rope.

7. Safety device according to claim 5, wherein the recess is diametrically opposite the holding means.

8. Safety device according to claim 2, wherein the holding means extend over the whole or part of the periphery of the pulley, so as to maintain the rope in a groove of said pulley and preventing it from sliding in the groove.

9. Safety device according to claim 3, wherein the holding means extend over the whole or part of the periphery of the pulley, so as to maintain the rope in a groove of said pulley and preventing it from sliding in the groove.

10. Safety device according to claim 4, wherein the holding means extend over the whole or part of the periphery of the pulley, so as to maintain the rope in a groove of said pulley and preventing it from sliding in the groove.

11. Safety device according to claim 4, wherein the holding means include at least one roller aimed at cooperating with the rope and rotationally mounted in a space provided for the passing through of said rope.

12. Device according to claim 1, wherein the means capable of controlling the speed of rotation of the pulley include means for braking the pulley through a fluid.

13. Device according to claim 1, wherein respective portions facing each other of the holding means and the frame comprise respective recesses facing each other, for cooperating with coupling means to secure the holding means with respect to the frame in the closed position of the holding means, so as to block the rope with respect to the pulley.

14. Rope combined with the device according to claim 1, which is arranged in a loop.

* * * * *